US012221661B2

(12) United States Patent
Kubo et al.

(10) Patent No.: US 12,221,661 B2
(45) **Date of Patent: *Feb. 11, 2025**

(54) STEEL SHEET AND METHOD FOR PRODUCING SAME

(71) Applicant: NIPPON STEEL CORPORATION, Tokyo (JP)

(72) Inventors: Masahiro Kubo, Tokyo (JP); Hiroyuki Kawata, Tokyo (JP); Kenichiro Otsuka, Tokyo (JP); Masafumi Azuma, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 675 days.

This patent is subject to a terminal disclaimer.

(21) Appl. No.: 17/428,715

(22) PCT Filed: Jan. 7, 2020

(86) PCT No.: PCT/JP2020/000126

§ 371 (c)(1),
(2) Date: Aug. 5, 2021

(87) PCT Pub. No.: WO2020/166231

PCT Pub. Date: Aug. 20, 2020

(65) Prior Publication Data

US 2022/0112569 A1 Apr. 14, 2022

(30) Foreign Application Priority Data

Feb. 15, 2019 (JP) ..... 2019-025635

(51) Int. Cl.
*C21D 8/00* (2006.01)
*C22C 38/02* (2006.01)
(Continued)

(52) U.S. Cl.
CPC ..... *C21D 8/005* (2013.01); *C22C 38/02* (2013.01); *C22C 38/04* (2013.01); *C22C 38/16* (2013.01); *C21D 9/46* (2013.01)

(58) Field of Classification Search
CPC ..... C21D 2211/005
See application file for complete search history.

(56) References Cited

U.S. PATENT DOCUMENTS

2004/0261919 A1 12/2004 Nakajima et al.
2012/0282487 A1* 11/2012 Ogawa ..... C23C 2/28 148/333
2020/0255931 A1* 8/2020 Schier ..... C23C 14/0641

FOREIGN PATENT DOCUMENTS

EP 3 480 334 A1 5/2019
JP 3-277741 A 12/1991
(Continued)

*Primary Examiner* — Nicholas A Wang
(74) *Attorney, Agent, or Firm* — Birch, Stewart, Kolasch & Birch, LLP

(57) ABSTRACT

A steel sheet includes, as a chemical composition, by mass %: C: 0.0015% to 0.0400%; Mn: 0.20% to 1.50%; P: 0.010% to 0.100%; Cr: 0.001% to 0.500%; Si: 0.200% or less; S: 0.020% or less; sol. Al: 0.200% or less; N: 0.0150% or less; Mo: 0% to 0.500%; B: 0% to 0.0100%; Nb: 0% to 0.200%; Ti: 0% to 0.200%; Ni: 0% to 0.200%; Cu: 0% to 0.100%; and a remainder including iron and impurities, in which a metallographic structure in a surface layer region includes ferrite having a volume fraction of 90% or more, and in the surface layer region, an average grain size of the ferrite is 1.0 μm to 15.0 μm, and a texture in which an $X_{ODF\{001\}/\{111\},S}$ as a ratio of an intensity of {001} orientation to an intensity of {111} orientation in the ferrite is 0.30 or more and less than 3.50 is included.

13 Claims, 1 Drawing Sheet

(51) Int. Cl.

| | |
|---|---|
| ***C22C 38/04*** | (2006.01) |
| ***C22C 38/16*** | (2006.01) |
| *C21D 9/46* | (2006.01) |

(56) References Cited

FOREIGN PATENT DOCUMENTS

| | | | |
|---|---|---|---|
| JP | 5-78784 | A | 3/1993 |
| JP | 08-337843 | A | 12/1996 |
| JP | 2001-279378 | A | 10/2001 |
| JP | 2007-92129 | A | 4/2007 |
| JP | 2010-255068 | A | 11/2010 |
| JP | 2012-233229 | A | 11/2012 |
| JP | 2013-87331 | A | 5/2013 |
| JP | 2015-145523 | A | 8/2015 |
| JP | 2016-156079 | A | 9/2016 |
| KR | 10-2018-0125598 | A | 11/2018 |
| WO | WO 2004/001084 | A1 | 12/2003 |

* cited by examiner

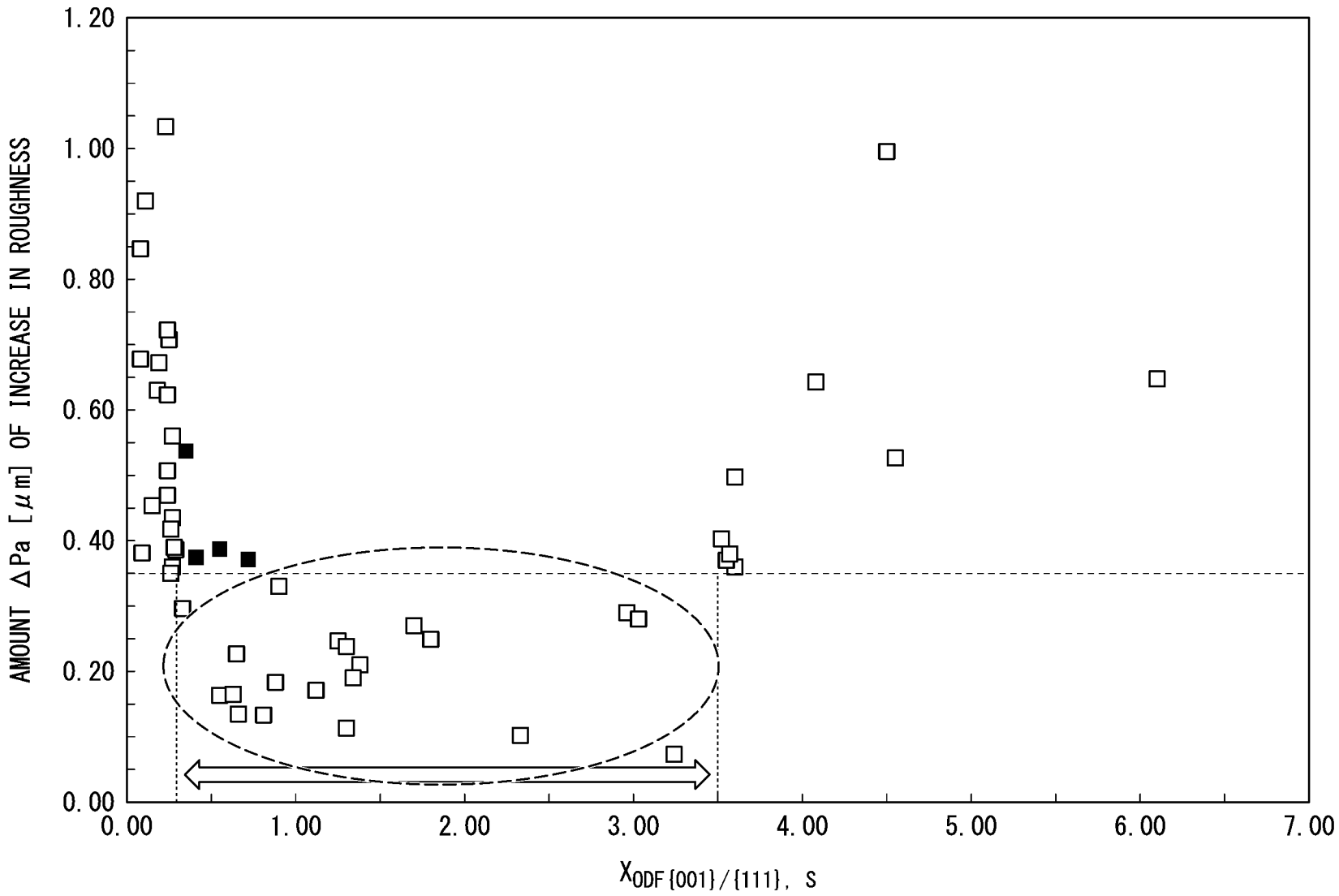
AMOUNT ΔPa [μm] OF INCREASE IN ROUGHNESS
1.20
1.00
0.80
0.60
0.40
0.20
0.00
0.00
1.00
2.00
3.00
4.00
5.00
6.00
7.00
X_ODF{001}/{111}, s

STEEL SHEET AND METHOD FOR PRODUCING SAME

TECHNICAL FIELD OF THE INVENTION

The present invention relates to a steel sheet and a method for manufacturing the same.

Priority is claimed on Japanese Patent Application No. 2019-025635, filed on Feb. 15, 2019, the content of which is incorporated herein by reference.

RELATED ART

Recently, in order to protect the global environment, it is desired to improve the fuel consumption of a vehicle. Regarding the improvement of the fuel consumption of a vehicle, high-strengthening is further required for a steel sheet for a vehicle in order to reduce the weight of a vehicle body while securing safety. This high-strengthening is required not only for a structural member such as a member or a pillar but also for an exterior component (for example, a roof, a hood, a fender, or a door) of a vehicle. For this requirement, a material has been developed in order to simultaneously achieve strength and elongation (formability).

On the other hand, the forming of an exterior panel component of a vehicle tends to become more complicated. When the strength of a steel sheet increases in order to reduce the weight, it is difficult to process the steel sheet in a complicated shape. When the thickness of a steel sheet is reduced in order to reduce the weight, a surface of the steel sheet is likely to be uneven during forming into a complicated shape. When the surface is uneven, the external appearance after forming deteriorates. Regarding an exterior panel component, not only properties such as strength but also design and surface quality are important. Therefore, the external appearance after forming is required to be excellent. The unevenness occurring after forming described herein refers to unevenness occurring on a surface of a formed component even when the steel sheet surface after manufacturing is not uneven. Even when the formability of the steel sheet is improved, the occurrence is not necessarily suppressed. Therefore, when a high strength steel sheet is applied to an exterior panel, there is a large problem.

Regarding a relationship between the external appearance after forming and material properties in a steel sheet to be applied to an exterior panel component, for example. Patent Document 1 discloses a ferritic steel sheet in which, in order to improve surface properties after stretching, an area fraction of crystal having a crystal orientation of less than ±15° from {001} plane parallel to a steel sheet surface is 0.25 or less and an average grain size of the crystal is 25 μm or less.

However, Patent Document 1 relates to a ferritic steel sheet in which a C content is 0.0060% or less. However, as a result of an investigation by the present inventors, it was found that, in the case of a steel sheet having a C content more than that of the steel sheet described in Patent Document 1, it is difficult to reduce the area fraction of crystal having a crystal orientation of less than ±15° from {001} plane parallel to a steel sheet surface. That is, with the method described in Patent Document 1, high-strengthening and improvement of surface properties after processing cannot be satisfied simultaneously.

For example. Patent Document 2 discloses a steel sheet including ferrite as a primary phase and having an excellent Young's modulus in an orthogonal-to-rolling direction in which an X-ray random intensity ratio in a thickness ¼ layer is controlled. However, Patent Document 2 does not disclose a relationship between the external appearance after forming and a structure from the viewpoint of a countermeasure against surface roughness or pattern defects.

That is, in the related art, a high strength steel sheet having excellent formability in which surface roughness or pattern defects after forming is improved is not disclosed.

PRIOR ART DOCUMENT

Patent Document

[Patent Document 1] Japanese Unexamined Patent Application. First Publication No. 2016-156079

[Patent Document 2] Japanese Unexamined Patent Application. First Publication No. 2012-233229

DISCLOSURE OF THE INVENTION

Problems to be Solved by the Invention

The present invention has been made in consideration of the above-described problems. An object of the present invention is to provide: a high strength steel sheet in which formability is excellent and the occurrence of surface unevenness during forming is suppressed; and a method for manufacturing the same.

Means for Solving the Problem

The present inventors conducted an investigation on a method for achieving the object.

As a result, it was found that the surface unevenness during forming occurs due to inhomogeneous deformation occurs due to inhomogeneous deformation during forming caused by inhomogeneity in strength in a microscopic region.

As a result of further thorough investigation by the present inventors, by controlling a metallographic structure such that ferrite is a primary phase in order to improve formability and by controlling an average grain size of ferrite and a texture of ferrite in a metallographic structure in a surface layer region to be different from those in an internal region of the steel sheet, a steel sheet in which the occurrence of surface unevenness after forming is suppressed such that the external appearance (surface appearance quality) after forming is excellent can be obtained.

In addition, as a result of investigation, the present inventors found that, in order to control the metallographic structure in the surface layer region, it is effective to apply strain after hot rolling instead of after cold rolling and to set a cold-rolling reduction and heat treatment conditions after the strain application depending on the working amount.

The present invention has been made based on the above findings, and the scope thereof is as follows.

[1] According to one aspect of the present invention, there is provided a steel sheet includes, as a chemical composition, by mass %: C: 0.0015% to 0.0400%; Mn: 0.20% to 1.50%; P: 0.010% to 0.100%; Cr: 0.001% to 0.500%; Si: 0.200% or less; S: 0.020% or less; sol. Al: 0.200% or less; N: 0.0150% or less; Mo: 0% to 0.500%; B: 0% to 0.0100%; Nb: 0% to 0.200%; Ti: 0% to 0.200%; Ni: 0% to 0.200%; Cu: 0% to 0.100%; and a remainder including iron and impurities, in which a metallographic structure in a surface layer region includes ferrite having a volume fraction of 90% or more, and in the surface layer region, an average grain size of the ferrite is 1.0 μm to 15.0 μm, and a texture in which an $X_{ODF\{001\}/\{111\},S}$ as a ratio of an intensity of {001} orientation to an intensity of {111} orientation in the ferrite is 0.30 or more and less than 3.50 is included.

[2] In the steel sheet according to [1], the chemical composition may include, by mass %, one or more selected from the group consisting of: Mo: 0.001% to 0.500%; B: 0.0001% to 0.0100%; Nb: 0.001% to 0.200%; Ti: 0.001% to 0.200%; Ni: 0.001% to 0.200%; and Cu: 0.001% to 0.100%.

[3] In the steel sheet according to [1] or [2], a texture in which an $X_{ODF\{001\}/\{111\},I}$ as a ratio of an intensity of {001} orientation to an intensity of {111} orientation in ferrite is 0.001 or more and less than 1.0 may be included in an internal region.

[4] In the steel sheet according to one of [1] to [3], the intensity ratio $X_{ODF\{001\}/\{111\},S}$ in the surface layer region and an $X_{ODF\{001\}/\{111\},I}$ as a ratio of an intensity of {001} orientation to an intensity of {111} orientation in ferrite in an internal region may satisfy the following Expression (1), and the average grain size of the ferrite in the surface layer region may be less than an average grain size of the ferrite in the internal region, $$-0.20<X_{ODF\{001\}/\{111\},S}-X_{ODF\{001\}/\{111\},I}<0.40 \quad (1).$$

[5] In the steel sheet according to one of [1] to [4], a plating layer may be provided on a surface.

[6] According to another aspect of the present invention, there is provided a method for manufacturing a steel sheet including: a heating process of heating a slab having the chemical composition according to [1] to 1000° C. or higher; a hot-rolling process of hot-rolling the slab such that a rolling finishing temperature is 950° C. or lower to obtain a hot-rolled steel sheet; a stress application process of applying a stress to the hot-rolled steel sheet after the hot-rolling process such that an absolute value of a residual stress $\sigma_S$ on a surface is 100 MPa to 250 MPa; a cold-rolling process of cold-rolling the hot-rolled steel sheet after the stress application process such that a cumulative rolling reduction $R_{CR}$ is 70% to 90% to obtain a cold-rolled steel sheet; an annealing process of heating the cold-rolled steel sheet such that an average heating rate in a range from 300° C. to a soaking temperature T1° C. that satisfies the following Expression (2) is 1.5° C./sec to 10.0° C./sec and holding the heated steel sheet at the soaking temperature T1° C. for 30 seconds to 150 seconds for annealing; and a cooling process of cooling the cold-rolled steel sheet after the annealing process to a temperature range of 550° C. to 650° C. such that an average coding rate in a range from the soaking temperature T1° C. to 650° C. is 1.0° C./sec to 10.0° C./sec and coding the coded steel sheet to a temperature range of 200° C. to 490° C. such that the average coding rate is 5° C./sec to 500° C./sec.

$$Ac_1+550-25\times\ln(\sigma_S)-4.5\times R_{CN}\leq T1\leq Ac_1+550-25\times\ln(\sigma_S)-4\times R_{CR} \quad (2)$$

$Ac_1$ in Expression (2) is represented by the following Expression (3). An element symbol in the following Expression (3) represents an amount of the corresponding element by mass %, and when the corresponding element is not included, 0 is substituted into the corresponding element symbol.

$$Ac_1=723-10.7\times Mn-16.9\times Ni+29.1\times Si+16.9\times Cr \quad (3)$$

[7] In the method for manufacturing a steel sheet according to [6], the stress application process may be performed at 40° C. to 500° C.

[8] In the method for manufacturing a steel sheet according to [6] or [7], in the hot-rolling process, a finish rolling start temperature may be 900° C. or lower.

[9] The method for manufacturing a steel sheet according to one of [6] to [8], may further include a holding process of holding the cold-rolled steel sheet after the cooling process in a temperature range of 200° C. to 490° C. for 30 seconds to 600 seconds.

Effects of the Invention

In the steel sheet according to the aspect of the present invention, the occurrence of surface unevenness is suppressed even after various deformation during press forming as compared to a material in the related art. Therefore, the steel sheet according to the aspect of the present invention has excellent appearance quality of the surface and can contribute to improvement of the vividness and design of coating. In addition, the steel sheet according to the present invention has high strength, and thus can contribute to further reduction in the weight of a vehicle. In addition, since formability is excellent, the steel sheet according to the present invention is also applicable to an exterior component having a complicated shape. In the present invention, the high strength represents a tensile strength of 340 MPa or higher.

In addition, with the method for manufacturing a steel sheet according to the aspect of the present invention, a high strength steel sheet in which formability is excellent and the occurrence of surface unevenness is suppressed even after various deformation during press forming can be manufactured.

BRIEF DESCRIPTION OF THE DRAWINGS

FIG. 1 is a diagram showing a relationship between surface properties after forming and a texture parameter.

EMBODIMENTS OF THE INVENTION

A steel sheet according to an embodiment of the present invention (the steel sheet according to the embodiment) includes, as a chemical composition, by mass %: C: 0.0015% to 0.0400%; Mn: 0.20% to 1.50%; P: 0.010% to 0.100%; Cr: 0.001% to 0.500%; Si: 0.200% or less; S: 0.020% or less; sol. Al: 0.200% or less; N: 0.0150% or less; Mo: 0% to 0.500%; B: 0% to 0.0100%; Nb: 0% to 0.200%; Ti: 0% to 0.200%; Ni: 0% to 0.200%; Cu: 0% to 0.100%; and a remainder including iron and impurities.

In addition, in the steel sheet according to the embodiment, a metallographic structure in a surface layer region includes ferrite having a volume fraction of 90% or more, and in the surface layer region, an average grain size of the ferrite is 1.0 μm to 15.0 μm, and a texture in which an $X_{ODF\{001\}/\{111\},S}$ as a ratio of an intensity of {001} orientation to an intensity of [111] orientation in the ferrite is 0.30 or more and less than 3.50 is included.

In the steel sheet according to the embodiment, it is preferable that a texture in which an $X_{ODF\{001\}/\{111\},I}$ as a ratio of an intensity of {001} orientation to an intensity of {111} orientation in ferrite is 0.001 or more and less than 1.00 is included in an internal region.

In addition, in the steel sheet according to the embodiment, it is preferable that the intensity ratio $X_{ODF\{001\}/\{111\},S}$ and an $X_{ODF\{001\}/\{111\},I}$ as a ratio of an intensity of {001} orientation to an intensity of {111} orientation in ferrite in an internal region satisfies the following Expression (1), and it is preferable that the average grain size of the ferrite in the surface layer region is less than an average grain size of the ferrite in the internal region.

$$-0.20<X_{ODF\{001\}/\{111\}S}-X_{ODF\{001\}/\{111\}I}<0.40 \quad (1).$$

Hereinafter, the steel sheet according to the embodiment will be described in detail. The present invention is not limited only to the configuration disclosed in the embodiment and can be modified within a range not departing from the scope of the present invention. A limited numerical range described below includes a lower limit value and an upper limit value. A numerical value shown together with "more than" or "less than" is not included in a numerical range. All the "%" in the chemical composition represents "mass %". First, the reason for limiting the chemical composition of the steel sheet according to the embodiment will be described.

<Regarding Chemical Composition>

[C: 0.0015% to 0.0400%]

C (carbon) is an element that increases the strength of the steel sheet. In addition, as the C content decreases, a {111} texture is likely to be developed. In order to obtain a desired strength and a desired texture, the C content is set to be 0.0015% or more. The C content is preferably 0.0030% or more and more preferably 0.0060% or more.

On the other hand, when the C content is more than 0.0400%, the formability of the steel sheet deteriorates. Therefore, the C content is set to be 0.0400% or less. The C content is preferably 0.0300% or less and more preferably 0.0200% or less.

[Mn: 0.20% to 1.50%]

Mn (manganese) is an element that increases the strength of the steel sheet. In addition, Mn is an element that immobilizes S (sulfur) in the steel as MnS or the like to prevent cracking during hot rolling. In order to obtain the effects, the Mn content is set to be 0.20% or more. The Mn content is preferably 0.30% or more.

On the other hand, when the Mn content is more than 1.50%, a cold rolling force during cold rolling at a high rolling reduction increases, and the productivity decreases. In addition, segregation of Mn is likely to occur. Therefore, the hard phase aggregates after annealing such that pattern defects are likely to be formed on the surface after forming. Therefore, the Mn content is set to be 1.50% or less. The Mn content is preferably 1.30% or less and more preferably 1.10% or less.

[P: 0.010% to 0.100%]

P (phosphorus) is an element that improves the strength of the steel sheet. In order to obtain a desired strength, the P content is set to be 0.010% or more. The P content is preferably 0.015% or more and more preferably 0.020% or more.

On the other hand, when an excess amount of P is included in the steel, cracking is promoted during hot rolling or cold rolling, and the ductility or weldability of the steel sheet deteriorates. Therefore, the P content is set to be 0.100% or less. It is preferable that the P content is set to be 0.080% or less.

[Cr: 0.001% to 0.500%]

Cr (chromium) is an element that improves the strength of the steel sheet. In order to obtain a desired strength, the Cr content is set to be 0.001% or more. The Cr content is preferably 0.050% or more.

On the other hand, when the Cr content is more than 0.500%, the strength of the steel sheet provided for cold rolling increases, and a cold rolling force during cold rolling at a high rolling reduction increases. In addition, the alloy cost increases. Therefore, the Cr content is set to be 0.500% or less. The Cr content is preferably 0.350% or less.

[Si: 0.200% or Less]

Si (silicon) is a deoxidizing element of steel that is effective for increasing the strength of the steel sheet. However, when the Si content is more than 0.200%, scale peelability during production deteriorates, and surface defects are likely to be formed on the product. In addition, a cold rolling force during cold rolling at a high rolling reduction increases, and the productivity decreases. Further, the weldability and the deformability of the steel sheet deteriorates. Therefore, the Si content is limited to 0.200% or less. The Si content is preferably 0.150% or less.

In addition, in order to reliably obtain the deoxidizing effect of steel and the effect of improving the strength, the Si content may be 0.005% or more.

[S: 0.020% or Less]

S (sulfur) is an impurity. When an excess amount of S is included in the steel, MnS stretched by hot rolling is formed, and the deformability of the steel sheet deteriorates. Therefore, the S content is limited to 0.020% or less. The S content is preferably small and may be 0%. In consideration of existing general refining (including secondary refining), the S content may be set to be 0.002% or more.

[Sol. Al: 0.200% or Less]

Al (aluminum) is a deoxidizing element of steel. However, when the sol. Al content is more than 0.200%, scale peelability during production deteriorates, and surface defects are likely to be formed on the product. In addition, the weldability of the steel sheet deteriorates. Therefore, the sol. Al content is set to be 0.200% or less. The sol. Al content is preferably 0.150% or less.

In addition, in order to reliably obtain the deoxidizing effect of steel the sol. Al content may be 0.020% or more.

[N: 0.0150% or Less]

N (nitrogen) is an impurity and is an element that deteriorates the deformability of the steel sheet. Accordingly, the N content is limited to 0.0150% or less. The N content is preferably small and may be 0%. However, in consideration of existing general refining (including secondary refining), the N content may be 0.0005% or more.

That is, the steel sheet according to the embodiment may include the above-described elements and a remainder including Fe and impurities. However, in order to improve various properties, the following elements (optional elements) may be included instead of a part of Fe. From the viewpoint of reducing the alloy cost, it is not necessary to add the optional elements to the steel on purpose. Therefore, the lower limit of the amount of each of the optional elements is 0%. The impurities refer to components that are unintentionally included from raw materials or other manufacturing processes in the process of manufacturing the steel sheet.

[Mo: 0% to 0.500%]

Mo (molybdenum) is an element that improves the strength of the steel sheet. In order to obtain a desired strength. Mo is optionally included. In order to obtain the effect, the Mo content is preferably 0.001% or more. The Mo content is more preferably 0.010% or more.

On the other hand, when the Mo content is more than 0.500%, the deformability of the steel sheet may deteriorate. In addition, the alloy cost increases. Therefore, the Mo content is set to be 0.500% or less. The Mo content is preferably 0.350% or less.

[B: 0% to 0.0100%]

B (boron) is an element that immobilizes carbon and nitrogen in the steel to form a fine carbonitride. The fine carbonitride contributes to precipitation hardening, microstructure control, grain refinement strengthening, and the like of the steel. Therefore, B may be optionally included. In order to obtain the effect, the B content is preferably 0.0001% or more.

On the other hand, when the B content is more than 0.0100%, the effect is saturated, and the workability (deformability) of the steel sheet may deteriorate. In addition, the strength of the steel sheet provided for cold rolling increases by including B. Therefore, a cold rolling force during cold rolling at a high rolling reduction increases. Therefore, when B is included, the B content is set to be 0.0100% or less.

[Nb: 0% to 0.200%]

Nb (niobium) is an element that immobilizes carbon and nitrogen in the steel to form a fine carbonitride. The fine Nb carbonitride contributes to precipitation hardening, microstructure control grain refinement strengthening, and the like of the steel. Therefore, Nb may be optionally included. In order to obtain the effect, the Nb content is preferably 0.001% or more.

On the other hand, when the Nb content is more than 0.200%, the effect is saturated, the strength of the steel sheet provided for cold rolling increases, and a cold rolling force during cold rolling at a high rolling reduction increases. Therefore, even when Nb is included, the Nb content is 0.200% or less.

[Ti: 0% to 0.200%]

Ti (titanium) is an element that immobilizes carbon and nitrogen in the steel to form a fine carbonitride. The fine carbonitride contributes to precipitation hardening, microstructure control, grain refinement strengthening, and the like of the steel. Therefore, Ti may be optionally included. In order to obtain this effect, the Ti content is preferably 0.001% or more.

On the other hand, when the Ti content is more than 0.200%, the effect is saturated, the strength of the steel sheet provided for cold rolling increases, and a cold rolling force during cold rolling at a high rolling reduction increases. Therefore, even when Ti is included, the Ti content is 0.200% or less.

[Ni: 0% to 0.200%]

Ni (nickel) is an element that contributes to the improvement of the strength of the steel sheet. Therefore, Ni may be optionally included. In order to obtain the effect, the Ni content is preferably 0.001% or more.

On the other hand, when the Ni content is excessively large, the strength of the steel sheet provided for cold rolling increases, and a cold rolling force during cold rolling at a high rolling reduction increases. In addition, inclusion of an excess amount of Ni causes an increase in alloy cost. Therefore, even when Ni is included, the Ni content is 0.200% or less.

[Cu: 0% to 0.100%]

Cu (copper) is an element that stabilizes austenite. By delaying transformation from austenite to ferrite, crystal grains are refined, which contributes to improvement of the strength. Therefore, Cu may be optionally included. In order to obtain the effect, the Cu content is preferably 0.001% or mote.

On the other hand, when the Cu content is more than 0.100%, the effect is saturated, the strength of the steel sheet provided for cold rolling increases, and a cold rolling force during cold rolling at a high rolling reduction increases. Therefore, even when Cu is included, the Cu content is 0.100% or less.

The above-described chemical composition of the steel sheet may be measured using a general analysis method. For example, the chemical composition may be measured using Inductively Coupled Plasma-Atomic Emission Spectrometry (ICP-AES). C and S may be measured using an infrared absorption method after combustion, and N may be measured using an inert gas fusion-thermal conductivity method. In a case where the steel sheet includes a plating layer on the surface, the chemical composition may be analyzed after removing the plating layer from the surface by mechanical grinding.

<Metallographic Structure of Surface Layer Region>

In the steel sheet according to the embodiment, when the sheet thickness is represented by t, a depth range from the surface to t/4 in a sheet thickness direction is divided into two regions, a depth range from the surface as a starting point to a depth position of 50 μm in a depth direction is represented by a surface layer region, and a range from the surface layer region to a center side of the steel sheet is represented by an internal region. When the thickness of the steel sheet is 0.20 mm or less, a region from the surface to a depth of t/4 in the sheet thickness direction is defined as a surface layer region, and a region with a depth of t/4 to t/2 is defined as an internal region. When the sheet thickness of the steel sheet is more than 0.40 mm, it is preferable that the internal region is a range from a position of more than 50 μm from the surface in the sheet thickness direction to a position of 100 μm from the surface in the sheet thickness direction.

As a result of a thorough investigation by the present inventors, it was found that the surface unevenness during forming occurs due to inhomogeneous deformation occurs during forming caused by inhomogeneity in strength in a microscopic region. In particular, it was found that the occurrence of surface roughness is largely affected by the metallographic structure in the surface layer region. Therefore, in the steel sheet according to the embodiment, the metallographic structure in the surface layer region is controlled as follows.

[Including Ferrite Having Volume Fraction of 90% or More]

When the volume fraction of the ferrite in the surface layer region is less than 90%, the surface appearance quality of the steel sheet after forming is likely to deteriorate. Therefore, the volume fraction of the ferrite is 90% or more. The volume fraction is preferably 95% or more or 98% or more. Since all the metallographic structures in the surface layer region may be formed of ferrite, the upper limit may be 100%.

The remainder in microstructure in the surface layer region includes, for example, one or more selected from the group consisting of pearlite, bainite, martensite, and tempered martensite. When the volume fraction of ferrite in the surface layer region is 100%, the volume fraction of the remainder in microstructure is 0%.

The volume fraction of ferrite in the surface layer region is obtained using the following method.

A sample (the size is substantially 20 mm in the rolling direction×20 mm in the width direction×the thickness of the steel sheet) for metallographic structure (microstructure) observation is collected from a W/4 position or a 3 W/4 position of a sheet width W of the steel sheet (that is, a W/4 position in the width direction from any end portion of the steel sheet in the width direction), and a metallographic structure (microstructure) in a range from the surface to the ¼ thickness position is observed using an optical microscope to calculate the area fraction of ferrite in a range from the surface of the steel sheet (in a case where a plating layer is present, the surface excluding the plating layer) to 50 μm.

In order to prepare the sample, a sheet thickness cross section in the orthogonal-to-rolling direction (direction perpendicular to the rolling direction) is polished as an observed section and is etched with the LePera reagent.

"Microstructures" are classified based on an optical microscope image at a magnification by 500-times. When the optical microscope observation is performed after the LePera corrosion, the respective structures are observed with different colors, for example, bainite is observed to be black, martensite (tempered martensite) is observed to be white, and ferrite is observed to be gray. Therefore, ferrite and other hard structures can be easily distinguished from each other.

A region ranging from the surface to a ¼ thickness position in the sheet thickness direction from the surface in the steel sheet etched with the LePera reagent is observed in 10 viewing fields at a magnification by 500-times, a region from the surface to a position of 50 μm of the steel sheet in the obtained optical microscope image is designated, and the image is analyzed using image analysis software "Photoshop CS5" (manufactured by Adobe Inc.) to obtain the area fraction of ferrite. In an image analysis method, for example, a maximum luminosity value $L_{max}$ and a minimum luminosity value $L_{min}$ of the image are acquired from the image, a portion that has pixels having a luminosity of $L_{max}-0.3\times(L_{max}-L_{min})$ to $L_{max}$ is defined as a white region, a portion that has pixels having a luminosity of $L_{min}$ to $L_{min}+0.3\times(L_{max}-L_{min})$ is defined as a black region, a portion other than the white and black regions is defined as a gray region, and the area fraction of ferrite that is the gray region is calculated. When the ferrite area ratio is 100%, the white region is not observed. Therefore, when the entire region is the gray region, the ferrite fraction is 100%. By performing the image analysis as described above in 10 observed viewing field in total, the area fraction of ferrite is measured. Further, the area fraction values are averaged to calculate the average value. This average value is set as the volume fraction of ferrite in the surface layer region.

When the thickness of the steel sheet is 0.20 mm or less, the above-described structure observation is performed on a region from the surface to a depth of t/4 in the sheet thickness direction.

[Average Grain Size of Ferrite being 1.0 μm to 15.0 μm]

When the average grain size of ferrite is more than 15.0 μm, the external appearance after forming deteriorates. Therefore, the average grain size of ferrite in the surface layer region is set to be 15.0 μm or less. The average grain size is preferably 12.0 μm or less.

On the other hand, when the average grain size of ferrite is less than 1.0 μm, ferrite grains having {001} orientation are likely to be formed in a state where they aggregate. Even in a case where each of the ferrite grains having {001} orientation is small, when the grains are formed in a state where they aggregate, deformation concentrates on the aggregated portion. Therefore, the external appearance after forming deteriorates. Therefore, the average grain size of ferrite in the surface layer region is set to be 1.0 μm or more. The average grain size is preferably 3.0 μm or more and more preferably 6.0 μm or more.

The average grain size of ferrite in the surface layer region can be obtained using the following method.

Using the same method as described above, a region ranging from the surface to a ¼ thickness position in the sheet thickness direction from the surface in the steel sheet etched with the LePera reagent is observed in 10 viewing fields at a magnification by 500-times, a region from the surface to a position of 50 μm×200 μm of the steel sheet in the optical microscope image is selected, and the image is analyzed using image analysis software "Photoshop CS5" (manufactured by Adobe Inc.) as described above to calculate the area fraction of ferrite and the number of ferrite grains, respectively. By adding up the values and dividing the area fraction of ferrite by the number of ferrite grains, the average area fraction per ferrite grain is calculated. The circle equivalent diameter is calculated based on the average area fraction and the number of grains, and the obtained circle equivalent diameter is set as the average grain size of ferrite. When the thickness of the steel sheet is 0.20 mm or less, a region of a depth from the surface of the steel sheet to t/4 in the optical microscope image×200 μm is selected, and the image is analyzed.

[Texture in which $X_{ODF\{001\}/\{111\},S}$ as Ratio of Intensity of {001} Orientation to Intensity of {111} Orientation in Ferrite is 0.30 or More and Less than 3.50 being Included]A texture in which an $X_{ODF\{001\}/\{111\},S}$ as a ratio of an intensity of {001} orientation to an intensity of {111} orientation in the ferrite (ratio between maximum values of X-ray random intensity ratios) is 0.30 or more and less than 3.50 is included in the surface layer region such that the external appearance of the steel sheet after forming is improved. The reason for this is not clear but is presumed to be that the inhomogeneous deformation on the surface is suppressed due to an interaction between the existence form of ferrite and the crystal orientation distribution of ferrite.

When $X_{ODF\{001\}/\{111\},S}$ is less than 0.30, inhomogeneous deformation caused by an orientation distribution and a difference in intensity of each crystal of the material is likely to occur, and deformation concentration on the orientation in the vicinity of {001} in ferrite is significant. On the other hand, when $X_{ODF\{001\}/\{111\},S}$ is more than 3.50, inhomogeneous deformation caused by an orientation distribution and a difference in intensity of each crystal of the material is likely to occur, and unevenness of the steel sheet surface is likely to occur.

$X_{ODF\{001\}/\{111\},S}$ as the ratio of the intensity of {001} orientation to the intensity of {111} orientation in ferrite of the surface layer region can be obtained in the following method using Electron Backscattering Diffraction (EBSD) method.

Regarding a sample provided for EBSD method, the steel sheet is polished by mechanical grinding, strain is removed by chemical polishing or electrolytic polishing, the sample is prepared such that the cross section in the sheet thickness direction including the range from the surface to the ¼ thickness position from the surface in the sheet thickness direction is a measurement surface, and the texture is measured. Regarding a sample collection position in the sheet width direction, the sample is collected in the vicinity of a sheet width position of W/4 or 3W/4 (position at a distance of ¼ of the sheet width from an end surface of the steel sheet).

In the region of the sample ranging from the surface of the steel sheet to 50 μm from the surface in the sheet thickness direction, a crystal orientation distribution is measured by EBSD method at a pitch of OS μm or less. When the thickness of the steel sheet is 0.20 mm or less, the measurement is performed on a region from the surface to a depth of t/4 in the sheet thickness direction. Ferrite is extracted using an Image Quality (IQ) map that is analyzable by EBSP-OIM (registered trade name, Electron Backscattering Diffraction Pattern-Orientation Image Microscopy). Ferrite has a characteristic in that the IQ value is high, and thus can be simply classified from other metallographic structures using this method. A threshold of the IQ value is set such that the area fraction of ferrite that is calculated by the observation of the microstructure obtained by the LePera corrosion matches the area fraction of ferrite calculated based on the IQ value.

In a cross section of $\phi 2=45°$ in a three-dimensional texture (ODF: Orientation Distribution Function) calculated using crystal orientations of the extracted ferrite, a ratio of a maximum value of X-ray random intensity ratios of a {001} orientation group to a maximum value of X-ray random intensity ratios of a {111} orientation group (γ-fiber) (the maximum value of X-ray random intensity ratios of {001} orientation group/the maximum value of X-ray random intensity ratios of {111} orientation group (γ-fiber)) is obtained as $X_{ODF\{001\}/\{111\},S}$. The X-ray random intensity ratio is a numerical value obtained by measuring a diffraction intensity of a standard sample having no pile-up in a specific orientation and a diffraction intensity of a sample material by X-ray diffraction under the same conditions and dividing the obtained diffraction intensity of the sample material by the diffraction intensity of the standard sample. For example, in a case where the steel sheet is rolled at a high rolling reduction erf 70% or higher and annealed, the texture is developed, and the X-ray random intensity of the {111} orientation group (γ-fiber) increases.

Here, {hkl} represents that, when a sample is collected using the above-described method, the normal direction of a sheet surface is parallel to <hkl>. Regarding the crystal orientation, typically, an orientation perpendicular to a sheet surface is represented by (hkl) or {hkl}. {hkl} is a generic term for equivalent planes, and (hkl) represents each of crystal planes. That is, in the embodiment, a body-centered cubic structure (bcc structure) is targeted. For example, the respective planes (111), (−111), (1−11). (11−1), (−1−11), (−11−1), (1−1−1), and (−1−1−1) are equivalent and cannot be distinguished from each other. In this case, these orientations are collectively referred to as "{111} orientation group". The ODF representation is used for representing other orientations of a crystal structure having low symmetry. Therefore, in the ODF representation, each of orientations is generally represented by (hkl)[uvw]. However, in the embodiment, attention is paid to the normal direction orientation {hkl} from which the finding that the normal direction orientation of a sheet surface has a large effect on the development of unevenness was obtained, (hkl) and (hkl) have the same definition.

In a case where the product is a steel sheet including a plating layer, the surface of the steel sheet excluding the plating layer is defined as an origin of the surface layer region.

<Regarding Metallographic Structure in Internal Region>

In the steel sheet according to the embodiment, it is preferable that, in a state where the metallographic structure in the surface layer region is controlled as described above, a metallographic structure in an internal region (in a case where the thickness of the steel sheet is 0.20 mm or less, a range from a t/4 position to a t/2 position) ranging from a position of more than 50 μm from the surface in the sheet thickness direction to a ¼ thickness position (in a case where the sheet thickness is represented by t: t/4) from the surface in the sheet thickness direction is also controlled.

[Texture in which $X_{ODF\{001\}/\{111\},I}$ as Ratio of Intensity of {001} Orientation to Intensity of {111} Orientation in Ferrite is 0.001 or More and Less than 1.00 being Included]

A texture in which an $X_{ODF\{001\}/\{111\},I}$ as a ratio of an intensity of {001} orientation to an intensity of {111} orientation in the ferrite (ratio between maximum values of X-ray random intensity ratios) is 0.001 or more and less than 1.00 is included in the internal region such that the external appearance of the steel sheet after forming can be further improved, which is preferable.

[Intensity Ratio $X_{ODF\{001\}/\{111\},S}$ and Intensity Ratio $X_{ODF\{001\}/\{111\},I}$ Satisfying Expression (1) ($-0.20<X_{ODF\{001\}/\{111\},S}-X_{ODF\{001\}/\{111\},I}<0.40$) and Average Grain Size of Ferrite in Surface Layer Region being Less than Average Grain Size of Ferrite in Internal Region]

When the intensity ratio $X_{ODF\{001\}/\{111\},S}$ in ferrite in the surface layer region and the intensity ratio $X_{ODF\{001\}/\{111\},I}$ in ferrite in the internal region satisfies the following Expression (1) and the average grain size of ferrite in the surface layer region is less than an average grain size of ferrite in the internal region, inhomogeneous deformation in the surface layer region is suppressed, which is preferable.

$$-0.20<X_{ODF\{001\}/\{111\},S}-X_{ODF\{001\}/\{111\},I}<0.40 \quad (1)$$

The average grain size in the internal region can be obtained by using a steel sheet etched with the LePera reagent, selecting a range from a position of more than 50 μm from the surface of the sample in the sheet thickness direction to a ¼ thickness position from the surface in the sheet thickness direction, and analyzing the range with the same method as that of the surface layer region.

In addition, a texture of ferrite in the internal region can be obtained by designating a range from a position of more than 50 μm from the surface of the sample in the sheet thickness direction to a ¼ thickness position from the surface in the sheet thickness direction by the above-described EBSD method and analyzing the range with the same method as that of the surface layer region.

When the thickness of the steel sheet is 0.20 mm or less, a range from a t/4 position to a t/2 position is selected and analyzed.

<Regarding Sheet Thickness>

The thickness of the steel sheet according to the embodiment is not particularly limited. However, in a case where the steel sheet is applied to an exterior member, when the sheet thickness is more than 0.55 mm, the contribution to a reduction in the weight of the member is small. In addition, when the sheet thickness is less than 0.12 mm, there may be a problem in rigidity. Therefore, the sheet thickness is preferably 0.12 mm to 0.55 mm.

In addition, the thickness of the steel sheet can be obtained by sampling a sheet from an end portion of a steel sheet coil in a longitudinal direction, collecting a sample for sheet thickness measurement from a position of 300 mm from the end portion in the sheet width direction, and measuring the thickness of the sample using a micrometer.

<Regarding Plating Layer>

The steel sheet according to the embodiment may include a plating layer on the surface (on the surface of the steel sheet). By including the plating layer on the surface, corrosion resistance is improved, which is preferable.

A plating to be applied is not particularly limited, and examples thereof include hot-dip galvanizing, hot-dip galvannealing, electrogalvanizing, Zn—Ni plating (alloy electrogalvanizing). Sn plating, Al—Si plating, electrogalvannealing, hot-dip zinc-aluminum alloy plating, hot-dip zinc-aluminum-magnesium alloy plating, hot-dip zinc-aluminum-magnesium alloy-Si plated steel sheet, and zinc-Al alloy deposition.

<Regarding Manufacturing Method>

Next, a preferable method for manufacturing the steel sheet according to the embodiment will be described. The effects can be obtained as long as the steel sheet according to the embodiment has the above-described properties irrespective of the manufacturing method. However, with the following method, the steel sheet can be stably manufactured, which is preferable.

Specifically, the steel sheet according to the embodiment can be manufactured with a manufacturing method including the following processes (i) to (vi).

(i) A heating process of heating a slab having the above-described chemical composition to 1000° C. or higher.

(ii) A hot-rolling process of hot-rolling the slab such that a rolling finishing temperature is 950° C. or lower to obtain a hot-rolled steel sheet.

(iii) A stress application process of applying a stress to the hot-rolled steel sheet after the hot-rolling process such that an absolute value of a residual stress $\sigma_S$ on a surface is 100 MPa to 250 MPa.

(iv) A cold-rolling process of cold-rolling the hot-rolled steel sheet after the stress application process such that a cumulative rolling reduction $R_{CR}$ is 70% to 90% to obtain a cold-rolled steel sheet.

(v) An annealing process of heating the cold-rolled steel sheet such that an average heating rate in a range from 300° C. to a soaking temperature T1° C. that satisfies the following Expression (2) is 1.5° C./sec to 10.0° C./sec and holding the heated steel sheet at the soaking temperature T1° C. for 30 seconds to 150 seconds for annealing.

$$Ac_1+550-25\times\ln(\sigma_S)-4.5\times R_{CN}\leq T1\leq Ac_1+550-25\times\ln(\sigma_S)-4\times R_{CR} \quad (2)$$

(Note that $Ac_1$ in Expression (2) is represented by Expression (3) $Ac_1=723-10.7\times Mn-16.9\times Ni+29.1\times Si+16.9\times Cr$)

(vi) A cooling process of cooling the cold-rolled steel sheet after the annealing process to a temperature range of 550° C. to 650° C. such that an average cooling rate in a range from the soaking temperature T1° C. to 650° C. is 1.0° C./sec to 10.0° C./sec and cooling the cooled steel sheet to a temperature range of 200° C. to 490° C. such that the average cooling rate is 5° C./sec to 500° C./sec.

In addition, in order to obtain the effect of tempering the hard phase that is present in a small amount, the manufacturing method may further the following process.

(vii) A holding process of holding the cold-rolled steel sheet after the cooling process in a temperature range of 200° C. to 490° C. for 30 seconds to 600 seconds.

Hereinafter, the each process will be described.

[Heating Process]

In the heating process, a slab having the predetermined chemical composition is heated to 1000° C. or higher before rolling. When the heating temperature is lower than 1000° C., a rolling reaction force during hot rolling increases, sufficient hot rolling cannot be performed, and there may be a case where the desired thickness of the product cannot be obtained. Alternatively, there may a case where the steel sheet cannot be coiled due to deterioration in the sheet shape.

It is not necessary to limit the upper limit of the heating temperature, and it is not preferable that the heating temperature is excessively high from the viewpoint of economy. Due to this reason, it is preferable that the slab heating temperature is lower than 1300° C. In addition, the slab provided for the heating process is not limited. For example, a slab that is manufactured using a continuous casting method after melting molten steel having the above-descried chemical composition using a converter or an electric furnace can be used. For example, an ingot-making method or a thin slab casting method may be adopted instead of the continuous casting method.

[Hot-Rolling Process]

In the hot-rolling process, the slab heated to 1000° C. or higher in the heating process is hot-rolled and coiled to obtain a hot-rolled steel sheet.

When the rolling finishing temperature is higher than 950° C., the average grain size of the hot-rolled steel sheet excessively increases. In this case, the average grain size of the final product sheet increases, and an increase in average grain size causes a decrease in yield strength and deterioration in the surface appearance quality after forming, which is not preferable. Therefore, the rolling finishing temperature is set to be preferably 950° C. or lower.

In addition, in order to reduce the grain size of the steel sheet and to improve the surface appearance quality, the finish rolling start temperature is preferably 900° C. or lower. The finish rolling start temperature is more preferably 850° C. or lower. In addition, from the viewpoint of reducing a rolling force during hot rolling, the rolling start temperature is preferably 700° C. or higher and more preferably 750° C. or higher.

When a temperature change (finish rolling finishing temperature−finish rolling start temperature) in the hot-rolling process is +5° C. or higher, recrystallization is promoted by deformation heating in the hot-rolling process, and crystal grains are refined, which is preferable.

In addition, in order to refine crystal grains, the coiling temperature in the coiling process is preferably 750° C. or lower and more preferably 650° C. or lower. In addition, from the viewpoint of reducing the strength of the steel sheet provided for cold rolling, the coiling temperature is preferably 450° C. or higher and more preferably 500° C. or higher.

[Stress Application Process]

In the stress application process, a stress is applied to the hot-rolled steel sheet after the hot-rolling process such that an absolute value of a residual stress $\sigma_S$ on a surface is 100 MPa to 250 MPa. For example, a stress can be applied by grinding the hot-rolled steel sheet using a surface grinding brush after hot rolling or pickling. At that time, while changing a contact pressure of the grinding brush on the steel sheet surface, a surface layer residual stress is measured on-line using a portable X-ray residual stress analyzer and may be controlled to be in the above-described range. By performing cold rolling, annealing, and cooling in a state where the residual stress is applied to the surface to be in the above-described range, a steel sheet including ferrite having a desired texture can be obtained.

When the residual stress a, is lower than 100 MPa or higher than 250 MPa, the desired texture can be obtained after cold rolling, annealing, and cooling to be performed after the stress application. In addition, in a case where the residual stress is applied after cold rolling instead of after hot rolling, the residual stress is widely distributed in the sheet thickness direction. Therefore, a desired metallographic structure cannot be obtained only on the surface layer of the material.

A method of applying the residual stress to the surface of the hot-rolled steel sheet is not limited to the above-described grinding brush. For example, a method of performing surface grinding such as shot blasting or machining may also be used. In the case of shot blasting, fine unevenness may occur on the surface due to collision with shot media, or shot media may be trapped to form defects during the next cold rolling or the like. Therefore, the method of applying the stress by grinding using a brush is preferable.

In addition, during rolling using a roll such as a skin pass, a stress is applied to the entire steel sheet in the thickness direction and the desired hard phase distribution and the texture cannot be obtained only on the surface layer of the material.

It is preferable that the stress application process is performed at a steel sheet temperature of 40° C. to 500° C. By performing the stress application process in this temperature range, the residual stress can be efficiently applied to the range corresponding to the surface layer region, and the cracking caused by the residual stress of the hot-rolled steel sheet can be suppressed,

[Cold-Rolling Process]

In the cold-rolling process, the hot-rolled steel sheet is cold-rolled after the stress application process such that a cumulative rolling reduction $R_{CR}$ is 70% to 90% to obtain a cold-rolled steel sheet. By cold-rolling the hot-rolled steel sheet to which the predetermined residual stress is applied at the above-described cumulative rolling reduction, ferrite having the desired texture can be obtained after annealing and cooling.

When the cumulative rolling reduction $R_{CR}$ is less than 70%, the texture of the cold-rolled steel sheet is not sufficiently developed. Therefore, the desired texture cannot be obtained after annealing. In addition, when the cumulative rolling reduction $R_{CR}$ is more than 90%, the texture of the cold-rolled steel sheet is excessively developed. Therefore, the desired texture cannot be obtained after annealing. In addition, the rolling force increases, and the homogeneity of the material in the sheet width direction deteriorates. Further, the production stability also deteriorates. Therefore, the cumulative rolling reduction $R_{CR}$ during cold rolling is set to be 70% to 90%.

[Annealing Process]

In the annealing process, the cold-rolled steel sheet is heated to the soaking temperature T1° C. at the average heating rate corresponding to $Ac_1$, the residual stress applied in the stress application process, and the cumulative rolling reduction $R_{CR}$ in the cold-rolling process, and is held at the soaking temperature corresponding to $Ac_1$, the residual stress applied in the stress application process, and the cumulative rolling reduction $R_{CR}$ in the cold-rolling process.

Specifically, in the annealing process, the cold-rolled steel sheet is heated such that an average heating rate in a range from 300° C. to a soaking temperature T1° C. that satisfies the following Expression (2) is 1.5° C./sec to 10.0° C./sec and holding the heated steel sheet at the soaking temperature T1° C. for 30 seconds to 150 seconds for annealing.

$$Ac_1+550-25\times\ln(\sigma_S)-4.5\times R_{CN}\leq T1\leq Ac_1+550-25\times\ln(\sigma_S)-4\times R_{CR} \quad (2)$$

$Ac_1$ in Expression (2) is represented by the following Expression (3). An element symbol in the following Expression (3) represents an amount of the corresponding element by mass %, and when the corresponding element is not included, 0 is substituted into the corresponding element symbol.

$$Ac_1=723-10.7\times Mn-16.9\times Ni+29.1\times Si+16.9\times Cr \quad (3)$$

When the average heating rate is slower than 1.5° C./sec, a long period of time is required for heating, and the productivity deteriorates, which is not preferable. In addition, when the average heating rate is faster than 10.0° C./sec, the homogeneity of the temperature in the sheet width direction deteriorates, which is not preferable.

In addition, when the soaking temperature T1 is lower than the left side of Expression (2), recrystallization of ferrite and reversible transformation from ferrite to austenite do not sufficiently progress, and the desired texture cannot be obtained. In addition, inhomogeneous deformation during forming is promoted due to a difference in intensity between non-recrystallized crystal grains and recrystallized crystal grains, which is not preferable. In addition, when the soaking temperature T1 is higher than the right side of Expression (2), recrystallization of ferrite and reversible transformation from ferrite to austenite sufficiently progresses, crystal grains are coarsened, and the desired texture cannot be obtained, which is not preferable.

The average heating rate can be obtained from (Heating End Temperature−Heating Start Temperature)/(Heating Time).

[Cooling Process]

In the cooling process, the cold-rolled steel sheet after soaking in the annealing process is cooled. During cooling, the cold-rolled steel sheet is cooled to a temperature range of 550° C. to 650° C. such that an average cooling rate in a range from the soaking temperature T1° C. to 650° C. is 1.0° C./sec to 10.0° C./sec. and is further cooled to a temperature range of 200° C. to 490° C. such that the average cooling rate is 5° C./sec to 500° C./sec.

When the average coding rate in a range from T1° C. to 650° C. is slower than 1.0° C./sec, the desired metallographic structure in the surface layer region cannot be obtained. On the other hand, when the average cooling rate is faster than 10.0° C., ferritic transformation does not sufficiently progress, and the desired volume fraction of ferrite cannot be obtained.

In addition, when the average cooling rate from this temperature range to a temperature range of 200° C. to 490° C. after cooling is performed in a temperature range of 550° C. to 650° C. is slower than 5° C./sec, the desired texture of ferrite cannot be obtained. On the other hand, it is difficult to set the average cooling rate to be faster than 500° C./sec due to the facility restriction. Therefore, the upper limit is set to be 500° C./sec.

The average cooling rate can be obtained from (Cooling Start Temperature−Cooling End Temperature)/(Cooling Time).

[Holding Process]

The cold-rolled steel sheet that is coded to 200° C. to 490° C. may be held in the temperature range of for 30 to 600 seconds.

By holding the cold-rolled steel sheet in the temperature range for the predetermined time, the effect of tempering the hard phase that is present in a small amount can be obtained, which is preferable.

The cold-rolled steel sheet that is coded to 200° C. to 490° C. or the cold-rolled steel sheet after the holding process may be cooled to room temperature at 10° C./sec or faster.

A plating process of forming a plating layer on the surface may be further performed on the cold-rolled steel sheet obtained using the above-described method. Examples of the plating process include the following process.

[Electroplating Process]

[Galvannealing Process]

The cold-rolled steel sheet after the cooling process or the holding process may be electroplated to form an electroplating layer on the surface. An electroplating method is not particularly limited. Conditions may be determined depending on required properties (for example, corrosion resistance or adhesion).

In addition, after electroplating, the cold-rolled steel sheet may be heated to alloy plating metal.

[Hot-Dip Galvanizing Process]

[Galvannealing Process]

The cold-rolled steel sheet after the cooling process or the holding process may be hot-dip galvanized to form a hot-dip galvanized layer on the surface. A hot-dip galvanizing method is not particularly limited. Conditions may be determined depending on required properties (for example, corrosion resistance or adhesion).

In addition, the cold-rolled steel sheet after hot-dip galvanizing may be heat-treated to alloy a plating layer. In a case where alloying is performed, it is preferable that the cold-rolled steel sheet is heat-treated in a temperature range of 400° C. to 600° C. for 3 to 60 seconds.

With the above-described manufacturing method, the steel sheet according to the embodiment can be obtained.

EXAMPLES

Next, examples of the present invention will be described. However, conditions of the examples are merely exemplary to confirm the operability and the effects of the present invention, and the present invention is not limited to these condition examples. The present invention can adopt various conditions within a range not departing from the scope of the present invention as long as the object of the present invention can be achieved under the conditions.

Steels having chemical compositions shown in "Steel Pieces No. A to T" of Table 1 were melted, and slabs having a thickness of 240 to 300 mm were manufactured by continuous casting. The obtained slabs were heated at a temperature shown in the tables. The heated slabs were hot-rolled under conditions shown in Table 2 and were coiled.

Next, the coil was uncoiled and a stress was applied to the hot-rolled steel sheet. At this time, while measuring the surface layer residual stress on-line using a portable X-ray residual stress analyzer at a working temperature (steel sheet temperature) shown in Table 2, a contact pressure of a grinding brush on the steel sheet surface was changed such that the residual stress $\sigma_S$ was as shown in Table 2. Next, by performing cold rolling at a cumulative rolling reduction $R_{CR}$ shown in Table 2, steel sheets A1 to T1 were obtained.

"Temperature Change in Hot-Rolling Process" in Table 2 shows a temperature change (finish rolling finishing temperature–finish rolling start temperature) in the hot-rolling process. In addition, in Table 2, the residual stress $\sigma_S$ is shown in the example (example where "*1" is shown in the field "Steel Sheet Temperature") where the stress application process was not performed. It is considered that this residual stress $\sigma_S$ was generated by inhomogeneity in cooling rate during steel sheet cooling.

Next, by performing annealing and cooling under conditions shown in Tables 3A and 3B, some steel sheets were held at 200° C. to 490° C. for 30 to 600 seconds. After cooling or holding, the steel sheets were air-cooled to room temperature. Next, some steel sheets were plated in various ways to form a (dating layer on the surface. In Tables 3A and 3B, CR represents that no (dating was performed, GI represents that hot-dip galvanizing was performed. GA represents that hot-dip galvannealing was performed, EG represents that electroplating was performed, EGA represents that electrogalvannealing was performed, and Sn, Zn—Al—Mg, Al—Si or the like represents that plating including these elements was performed. In addition, in Tables 3A and 3B, phosphate coating EG represents that phosphate coating electrogalvanizing was performed, and lubricant GA represents lubricant hot-dip galvannealing.

Regarding each of the product sheets No. A1a to T1a, the observation of the metallographic structures in the surface layer region and the internal region and the measurement of $X_{ODF\{001\}/\{111\},S}$, $X_{ODF\{001\}/\{111\},I}$ and the sheet thickness were performed using the above-described method. The results are shown in Tables 4A and 4B.

[Evaluation of Tensile Strength]

The tensile strength of the obtained product sheet was obtained in a tensile test that was performed according to JIS Z 2241 using a JIS No. 5 test piece cut from the direction perpendicular to the rolling direction. As a result, the tensile strengths of all the product sheets according to the present invention were 340 MPa or higher.

[Evaluation of Surface Properties of Steel Sheet]

In addition, regarding each of the manufactured product sheets, the surface properties of the steel sheet were evaluated.

Specifically, the surface of the manufactured steel sheet was observed by visual inspection to evaluate the surface properties. The evaluation criteria of the surface properties of the steel sheet were as follows.

A: no pattern was formed (more desirably, can be used as an exterior material)

B: an acceptable small pattern was formed (can be used as an exterior material)

C: an unacceptable pattern was formed (can be used as a component but cannot be used as an exterior material)

D: a significant pattern defect was formed (cannot be used as a component)

[Forming Test of Steel Sheet]

Regarding each of the manufactured product sheets, a forming test was performed.

Regarding forming, plastic strain of 10% in the rolling width direction was applied to the steel sheet of which the surface properties was measured in a cylinder drawing forming test with the Marciniak method using a deep drawing tester, a cylindrical punch of ϕ50 mm, and a cylindrical die of ϕ54 mm.

A test piece of 100 mm in the rolling width direction×50 mm in the rolling direction was prepared from a portion deformed by forming, and an arithmetic mean height Pa of a profile curve defined by JIS B0601 (2001) was measured in the direction perpendicular to the rolling direction according to JIS B0633 (2001). The evaluation was performed in the portion deformed by forming, and the evaluation length was 30 mm.

A test piece of 100 mm in the rolling width direction×50 mm in the rolling direction was prepared from a flat portion of the formed article, and an arithmetic mean height Pa of a profile curve defined by JIS B0601 (2001) was measured in the direction perpendicular to the rolling direction according to JIS B0633 (2001). The evaluation length was 30 mm.

The amount ΔPa of increase in roughness (ΔPa=Pa of Formed Article−Pa of Steel Sheet) was calculated using Pa of the formed article and Pa of the steel sheet obtained in the above-described measurement test.

The surface properties of the steel sheet after forming were evaluated based on the ΔPa. The evaluation criteria were as follows.

A: ΔPa≤0.25 μm (more desirably, can be used as an exterior material)

B: 0.25 μm<ΔPa≤0.35 μm (can be used as an exterior material)

C: 0.35 μm<ΔPa≤0.55 μm (can be used as a component but cannot be used as an exterior material)

D: 0.55 μm<ΔPa (cannot be used as a component)

[Comprehensive Evaluation]

Regarding evaluation criteria of the surface properties, among the above-described two evaluation results (the evaluation of the surface properties of the steel sheet and the evaluation of the surface properties after forming), an evaluation result having a lower score was obtained as the comprehensive evaluation. In a case where the result of the comprehensive evaluation was C or D, the steel sheet was not able to be used as an exterior material or a component and was determined to be unacceptable.

A: more desirably, the material can be used as an exterior material

B: the material can be used as an exterior material

C: the material cannot be used as an exterior material

D: the material cannot be used as a component

The above-described test results are shown in Tables 4A and 4B.

TABLE 1

| Slab | Chemical Composition mass % (Remainder: Fe + Impurities) | | | | | | | | | | | | | | |
|---|---|---|---|---|---|---|---|---|---|---|---|---|---|---|---|
| No. | C | Si | Mn | P | S | sol. Al | N | Cr | Mo | B | Nb | Ti | Ni | Cu | $Ac_1$ |
| A | 0.0110 | 0.020 | 0.40 | 0.080 | 0.003 | 0.042 | 0.0030 | 0.100 | 0.010 | 0.0000 | 0.003 | 0.000 | 0.001 | 0.000 | 721 |
| B | 0.0400 | 0.010 | 0.26 | 0.030 | 0.007 | 0.030 | 0.0030 | 0.005 | 0.300 | 0.0000 | 0.003 | 0.000 | 0.000 | 0.010 | 721 |
| C | 0.0015 | 0.010 | 0.58 | 0.015 | 0.006 | 0.050 | 0.0025 | 0.400 | 0.100 | 0.0013 | 0.013 | 0.001 | 0.013 | 0.000 | 724 |
| D | 0.0025 | 0.012 | 0.84 | 0.024 | 0.010 | 0.050 | 0.0022 | 0.032 | 0.001 | 0.0009 | 0.003 | 0.004 | 0.000 | 0.000 | 715 |
| E | 0.0320 | 0.010 | 1.12 | 0.020 | 0.003 | 0.045 | 0.0028 | 0.002 | 0.001 | 0.0005 | 0.002 | 0.000 | 0.010 | 0.010 | 711 |
| F | 0.0070 | 0.080 | 0.25 | 0.050 | 0.005 | 0.195 | 0.0040 | 0.001 | 0.001 | 0.0000 | 0.002 | 0.005 | 0.000 | 0.000 | 723 |
| G | 0.0100 | 0.200 | 0.20 | 0.010 | 0.006 | 0.030 | 0.0033 | 0.004 | 0.010 | 0.0000 | 0.000 | 0.003 | 0.010 | 0.000 | 727 |
| H | 0.0080 | 0.030 | 1.50 | 0.050 | 0.005 | 0.050 | 0.0040 | 0.005 | 0.001 | 0.0000 | 0.013 | 0.000 | 0.000 | 0.010 | 708 |
| I | 0.0100 | 0.020 | 1.20 | 0.060 | 0.004 | 0.045 | 0.0040 | 0.002 | 0.000 | 0.0000 | 0.004 | 0.000 | 0.010 | 0.000 | 711 |
| J | 0.0014 | 0.200 | 0.20 | 0.050 | 0.006 | 0.030 | 0.0020 | 0.001 | 0.000 | 0.0000 | 0.000 | 0.002 | 0.000 | 0.000 | 727 |
| K | 0.0080 | 0.030 | 1.65 | 0.020 | 0.006 | 0.030 | 0.0033 | 0.004 | 0.010 | 0.0000 | 0.000 | 0.002 | 0.004 | 0.000 | 706 |
| L | 0.0100 | 0.400 | 0.20 | 0.020 | 0.006 | 0.030 | 0.0033 | 0.004 | 0.000 | 0.0000 | 0.000 | 0.007 | 0.000 | 0.000 | 733 |
| M | 0.0200 | 0.050 | 0.40 | 0.015 | 0.001 | 0.025 | 0.0110 | 0.600 | 0.550 | 0.0002 | 0.020 | 0.000 | 0.010 | 0.000 | 730 |
| N | 0.0370 | 0.010 | 0.15 | 0.010 | 0.005 | 0.029 | 0.0028 | 0.001 | 0.001 | 0.0000 | 0.000 | 0.000 | 0.000 | 0.000 | 722 |
| O | 0.0500 | 0.070 | 0.40 | 0.015 | 0.001 | 0.025 | 0.0090 | 0.020 | 0.001 | 0.0000 | 0.002 | 0.030 | 0.000 | 0.000 | 721 |
| P | 0.0035 | 0.130 | 1.53 | 0.030 | 0.006 | 0.040 | 0.0030 | 0.023 | 0.000 | 0.0000 | 0.001 | 0.000 | 0.040 | 0.020 | 710 |
| Q | 0.0100 | 0.020 | 0.20 | 0.020 | 0.006 | 0.210 | 0.0033 | 0.004 | 0.001 | 0.0000 | 0.000 | 0.001 | 0.000 | 0.000 | 722 |
| R | 0.0065 | 0.010 | 1.37 | 0.104 | 0.005 | 0.125 | 0.0040 | 0.010 | 0.000 | 0.0000 | 0.000 | 0.010 | 0.000 | 0.000 | 709 |
| S | 0.0300 | 0.011 | 1.33 | 0.005 | 0.002 | 0.120 | 0.0045 | 0.001 | 0.001 | 0.0000 | 0.000 | 0.000 | 0.000 | 0.000 | 709 |
| T | 0.0090 | 0.030 | 0.60 | 0.050 | 0.005 | 0.150 | 0.0040 | 0.020 | 0.000 | 0.0000 | 0.000 | 0.000 | 0.000 | 0.000 | 718 |

The underline represents that the value is outside of the range of the present invention.

TABLE 2

| | | | Hot-Rolling Process | | | | | | Cold-Rolling |
|---|---|---|---|---|---|---|---|---|---|
| | | Heating Process | Finish Rolling | Rolling | Change in Temperature | Coiling Process | Stress Application Process | | Process Cumulative |
| Slab No. | Steel Sheet No. | Heating Temperature ° C. | Start Temperature ° C. | Finishing Temperature ° C. | of Hot-Rolling Process ° C. | Coiling Temperature ° C. | Residua] Stress σs MPa | Steel Sheet Temperature ° C. | Rolling Reduction $R_{CR}$ % |
| A | A1 | 1200 | 950 | 890 | −60 | 500 | 167 | 112 | 78 |
| A | A2 | 1200 | 950 | 890 | −60 | 600 | 120 | 40 | 85 |
| A | A3 | 1200 | 950 | 890 | −60 | 530 | 101 | 112 | 92 |
| A | A4 | 1220 | 990 | 910 | −80 | 600 | 34 | 162 | 85 |
| B | B1 | 1200 | 930 | 880 | −50 | 460 | 47 | 30 | 77 |
| B | B2 | 1100 | 850 | 865 | 15 | 460 | 111 | 242 | 85 |
| B | B3 | 1200 | 810 | 840 | 30 | 600 | 159 | 43 | 85 |
| B | B4 | 1200 | 930 | 880 | −50 | 550 | 201 | 30 | 80 |
| C | C1 | 1200 | 910 | 890 | −20 | 640 | 189 | 30 | 85 |
| C | C2 | 1200 | 845 | 870 | 25 | 640 | 129 | 103 | 80 |
| C | C3 | 1050 | 800 | 850 | 50 | 680 | 29 | X1 | 90 |
| C | C4 | 1050 | 800 | 850 | 50 | 680 | 108 | 30 | 66 |
| C | C5 | 1050 | 800 | 850 | 50 | 700 | 252 | 20 | 72 |
| C | C6 | 1200 | 1010 | 900 | −110 | 640 | 20 | 120 | 85 |
| C | C7 | 1230 | 1030 | 930 | −100 | 660 | 16 | 130 | 85 |
| D | D1 | 1100 | 850 | 885 | 35 | 700 | 107 | 30 | 90 |
| D | D2 | 1100 | 850 | 885 | 35 | 700 | 144 | 30 | 87 |
| D | D3 | 1100 | 850 | 885 | 35 | 560 | 32 | 30 | 92 |
| E | E1 | 1300 | 1080 | 950 | −130 | 560 | 105 | 120 | 85 |
| E | E2 | 1280 | 1050 | 930 | −120 | 700 | 101 | 50 | 85 |
| E | E3 | 1100 | 860 | 875 | 15 | 680 | 108 | 40 | 87 |
| E | E4 | 1100 | 860 | 875 | 15 | 680 | 24 | 40 | 81 |
| F | F1 | 1200 | 950 | 900 | −50 | 700 | 266 | 27 | 92 |
| F | F2 | 1200 | 950 | 900 | −50 | 700 | 108 | 25 | 90 |
| G | G1 | 1100 | 850 | 885 | 35 | 750 | 146 | 30 | 85 |
| G | G2 | 1100 | 850 | 885 | 35 | 750 | 276 | 503 | 87 |
| G | G3 | 1100 | 850 | 885 | 35 | 600 | 66 | 75 | 68 |
| H | H1 | 1200 | 930 | 890 | −40 | 550 | 94 | 45 | 85 |

TABLE 2-continued

| | | Hot-Rolling Process | | | | | | | Cold-Rolling |
|---|---|---|---|---|---|---|---|---|---|
| | | Heating Process | Finish Rolling | Rolling | Change in Temperature | Coiling Process | Stress Application Process | | Process Cumulative |
| Slab No. | Steel Sheet No. | Heating Temperature ° C. | Start Temperature ° C. | Finishing Temperature ° C. | of Hot-Rolling Process ° C. | Coiling Temperature ° C. | Residua] Stress σs MPa | Steel Sheet Temperature ° C. | Rolling Reduction $R_{CR}$ % |
| H | H2 | 1200 | 930 | 890 | −40 | 680 | 106 | 45 | 77 |
| H | H3 | 1300 | 1090 | 960 | −130 | 600 | 111 | 45 | 85 |
| I | I1 | 1200 | 850 | 890 | 40 | 600 | 111 | 30 | 82 |
| I | I2 | 1200 | 850 | 890 | 40 | 650 | 15 | *1 | 82 |
| J | J1 | 1200 | 910 | 890 | −20 | 700 | 141 | 35 | 83 |
| J | J2 | 1200 | 910 | 890 | −20 | 580 | 104 | 50 | 83 |
| K | K1 | 1200 | 920 | 890 | −30 | 520 | 127 | 20 | 88 |
| K | K2 | 1200 | 820 | 845 | 25 | 480 | 111 | 25 | 82 |
| L | L1 | 1250 | 850 | 880 | 30 | 670 | 26 | 50 | 85 |
| L | L2 | 1250 | 850 | 880 | 30 | 700 | 232 | 25 | 82 |
| M | M1 | 1200 | 925 | 895 | −30 | 600 | 103 | 110 | 87 |
| M | M2 | 1200 | 925 | 895 | −30 | 580 | 55 | 110 | 92 |
| N | N1 | 1250 | 960 | 910 | −50 | 600 | 138 | 30 | 87 |
| O | O1 | 1200 | 925 | 870 | −55 | 650 | 156 | 45 | 72 |
| P | P1 | 1100 | 860 | 865 | 5 | 550 | 34 | *1 | 80 |
| P | P2 | 1200 | 950 | 890 | −60 | 760 | 112 | 40 | 80 |
| Q | Q1 | 1200 | 950 | 905 | −45 | 650 | 113 | 40 | 72 |
| R | R1 | 1200 | 920 | 890 | −30 | 550 | 37 | *1 | 80 |
| S | S1 | 1200 | 930 | 880 | −50 | 500 | 133 | 300 | 80 |
| S | S2 | 1200 | 930 | 880 | −50 | 500 | 267 | 25 | 92 |
| T | T1 | 1100 | 850 | 865 | 15 | 550 | 105 | 45 | 80 |

The underline represents that the value is outside of the range of the present invention.

*1 represents that the stress application process was not performed.

TABLE 3A

| | | Annealing Process | | | | | Cooling Process |
|---|---|---|---|---|---|---|---|
| Steel Sheet No. | Product Sheet No. | Average Heating Rate ° C./s | Left Side of Expression (2) | Right Side of Expression (2) | Soaking Temperature T1 ° C. | Annealing Time sec | Average Cooling Rate in T1° C. to 650° C. ° C./s |
| A1 | A1a | 5.8 | 792 | 831 | 810 | 60 | 6.2 |
| A1 | A1b | 3.3 | 792 | 831 | 852 | 100 | 3.8 |
| A2 | A2a | 2.7 | 769 | 811 | 800 | 60 | 3.1 |
| A2 | A2b | 3.7 | 769 | 811 | 750 | 90 | 4.3 |
| A2 | A2c | 3.7 | 769 | 811 | 800 | 90 | 4.3 |
| A3 | A3a | 2.7 | 742 | 788 | 785 | 120 | 3.1 |
| A4 | A4a | 3.2 | 800 | 843 | 810 | 80 | 2.6 |
| B1 | B1a | 2.7 | 828 | 866 | 820 | 120 | 3.1 |
| B2 | B2a | 3.7 | 771 | 813 | 800 | 90 | 4.3 |
| B3 | B3a | 5.8 | 762 | 804 | 800 | 60 | 6.2 |
| B4 | B4a | 2.7 | 778 | 818 | 790 | 120 | 3.1 |
| B4 | B4b | 3.7 | 778 | 818 | 790 | 90 | 4.3 |
| C1 | C1a | 2.0 | 760 | 803 | 790 | 140 | 2.9 |
| C2 | C2a | 2.0 | 792 | 832 | 810 | 140 | 2.9 |
| C3 | C3a | 2.0 | 784 | 829 | 810 | 140 | 2.9 |
| C4 | C4a | 5.4 | 860 | 893 | 840 | 60 | 6.2 |
| C5 | C5a | 1.7 | 811 | 847 | 820 | 150 | 3.0 |
| C6 | C6a | 2.9 | 816 | 859 | 820 | 4 | 2.8 |
| C7 | C7a | 3.2 | 822 | 864 | 830 | 90 | 3.2 |
| D1 | D1a | 4.2 | 743 | 788 | 770 | 80 | 4.8 |
| D2 | D2a | 3.2 | 749 | 793 | 780 | 110 | 3.6 |
| D3 | D3a | 2.5 | 764 | 810 | 800 | 130 | 2.9 |
| E1 | E1a | 5.8 | 762 | 805 | 800 | 60 | 6.2 |
| E2 | E2a | 2.7 | 763 | 806 | 800 | 120 | 3.1 |
| E3 | E3a | 9.5 | 753 | 796 | 780 | 30 | 9.9 |
| E3 | E3b | 3.7 | 753 | 796 | 780 | 90 | 4.3 |
| E4 | E4a | 3.7 | 817 | 858 | 820 | 90 | 4.3 |
| F1 | F1a | 3.8 | 719 | 765 | 740 | 70 | 6.7 |
| F2 | F2a | 2.7 | 751 | 796 | 790 | 120 | 3.1 |

TABLE 3A-continued

| Steel Sheet No. | Cooling Process: Cooling Stop Temperature ° C. | Cooling Process: Average Cooling Rate in 200° C. to 490° C. | Cooling Process: Cooling Stop Temperature ° C. | Holding Process | Surface Treatment Type of Plating | Sheet Thickness mm |
|---|---|---|---|---|---|---|
| A1 | 570 | 40 | 400 | Not Provided | GA | 0.50 |
| A1 | 570 | 15 | 400 | Provided | GA | 0.50 |
| A2 | 570 | 8 | 350 | Not Provided | GI | 0.35 |
| A2 | 570 | 10 | 350 | Provided | GI | 0.35 |
| A2 | 570 | 10 | 400 | Provided | GA | 0.35 |
| A3 | 570 | 8 | 450 | Not Provided | GA | 0.25 |
| A4 | 580 | 9 | 450 | Not Provided | GA | 0.45 |
| B1 | 570 | 8 | 450 | Not Provided | GA | 0.65 |
| B2 | 600 | 10 | 450 | Not Provided | GA | 0.40 |
| B3 | 560 | 16 | 400 | Not Provided | GA | 0.40 |
| B4 | 570 | 8 | 400 | Provided | Zn—Al—Mg—Si | 0.45 |
| B4 | 580 | 10 | 450 | Not Provided | Lubricant GA | 0.45 |
| C1 | 570 | 7 | 420 | Not Provided | GI | 0.40 |
| C2 | 610 | 7 | 450 | Not Provided | Al—Si | 0.45 |
| C3 | 620 | 7 | 450 | Not Provided | Zn—Al | 0.20 |
| C4 | 600 | 40 | 200 | Provided | CR | 0.70 |
| C5 | 570 | 10 | 300 | Provided | GA | 0.57 |
| C6 | 570 | 11 | 460 | Not Provided | GA | 0.40 |
| C7 | 580 | 8 | 470 | Not Provided | GA | 0.40 |
| D1 | 550 | 14 | 400 | Not Provided | Zn—Al—Mg | 0.25 |
| D2 | 570 | 9 | 400 | Not Provided | GA | 0.40 |
| D3 | 560 | 7 | 490 | Not Provided | GA | 0.18 |
| E1 | 580 | 16 | 470 | Not Provided | GA | 0.35 |
| E2 | 590 | 8 | 460 | Not Provided | GA | 0.35 |
| E3 | 580 | 80 | 400 | Not Provided | GA | 0.30 |
| E3 | 570 | 20 | 450 | Not Provided | GA | 0.30 |
| E4 | 570 | 20 | 460 | Not provided | GA | 0.55 |
| F1 | 570 | 80 | 250 | Provided | EG | 0.11 |
| F2 | 580 | 8 | 450 | Not Provided | Sn | 0.14 |

The underline represents that the value is outside of the range of the present invention.

TABLE 3B

| Steel Sheet No. | Product Sheet No. | Annealing Process: Average Heating Rate ° C. | Annealing Process: Left Side of Expression (2) | Annealing Process: Right Side of Expression (2) | Annealing Process: Soaking Temperature T1 ° C. | Annealing Process: Annealing Time sec | Cooling Process: Average Cooling Rate in T1° C. to 650° C. ° C./s |
|---|---|---|---|---|---|---|---|
| G1 | G1a | 2.7 | 769 | 812 | 780 | 120 | 3.1 |
| G2 | G2a | 5.8 | 745 | 788 | 770 | 60 | 6.2 |
| G3 | G3a | 2.5 | 866 | 900 | 830 | 110 | 4.3 |
| H1 | H1a | 1.7 | 762 | 804 | 800 | 150 | 3.0 |
| H2 | H2a | 3.4 | 795 | 833 | 820 | 80 | 6.0 |
| H3 | H3a | 1.7 | 758 | 800 | 800 | 150 | 3.0 |
| I1 | I1a | 6.6 | 774 | 815 | 810 | 50 | 7.6 |
| I2 | I2a | 6.6 | 824 | 865 | 825 | 50 | 7.6 |

TABLE 3B-continued

| | | | | | | | |
|---|---|---|---|---|---|---|---|
| J1 | J1a | 6.6 | 780 | 821 | 780 | 50 | 7.6 |
| J2 | J2a | 2.2 | 787 | 829 | 790 | 120 | 3.9 |
| K1 | K1a | 2.9 | 739 | 783 | 750 | 90 | 5.2 |
| K2 | K2a | 2.5 | 769 | 810 | 770 | 110 | 4.3 |
| L1 | L1a | 2.2 | 819 | 861 | 810 | 120 | 3.9 |
| L2 | L2a | 2.2 | 777 | 818 | 780 | 120 | 3.9 |
| L2 | L2b | 3.7 | 777 | 818 | 780 | 90 | 4.3 |
| L2 | L2c | 9.3 | 777 | 818 | 780 | 150 | 9.9 |
| M1 | M1a | 2.0 | 773 | 816 | 775 | 150 | 1.1 |
| M2 | M2a | 11.5 | 766 | 812 | 770 | 30 | 9.9 |
| N1 | N1a | 4.4 | 757 | 801 | 760 | 60 | 7.7 |
| O1 | O1a | 4.2 | 821 | 857 | 830 | 80 | 4.8 |
| P1 | P1a | 5.4 | 812 | 852 | 820 | 60 | 6.2 |
| P2 | P2a | 3.8 | 782 | 822 | 800 | 100 | 5.4 |
| Q1 | Q1a | 2.7 | 829 | 865 | 830 | 120 | 3.1 |
| R1 | R1a | 2.7 | 809 | 849 | 800 | 120 | 3.1 |
| S1 | S1a | 3.7 | 777 | 817 | 800 | 90 | 4.4 |
| S2 | S2a | 3.7 | 705 | 751 | 800 | 90 | 4.3 |
| T1 | T1a | 2.7 | 791 | 831 | 820 | 120 | 3.1 |

| | Cooling Process | | | | | |
|---|---|---|---|---|---|---|
| Steel Sheet No. | Cooling Stop Temperature ° C. | Average Cooling Rate in 200° C. to 490° C. ° C./s | Cooling Stop Temperature ° C. | Holding Process | Surface Treatment Type of Plating | Sheet Thickness mm |
| G1 | 570 | 8 | 350 | Not | GI | 0.40 |
| G2 | 570 | 16 | 350 | Provided | GI | 0.35 |
| G3 | 570 | 20 | 250 | Provided | CR | 0.77 |
| H1 | 550 | 10 | 300 | Provided | CR | 0.35 |
| H2 | 610 | 20 | 300 | Provided | CR | 0.50 |
| H3 | 580 | 10 | 300 | Provided | CR | 0.38 |
| I1 | 570 | 100 | 300 | Provided | CR | 0.45 |
| I2 | 570 | 100 | 200 | Provided | CR | 0.45 |
| J1 | 590 | 100 | 250 | Provided | Phosphate Coating EG | 0.50 |
| J2 | 560 | 50 | 300 | Provided | CR | 0.50 |
| K1 | 560 | 24 | 400 | Provided | CR | 0.30 |
| K2 | 550 | 20 | 200 | Not | CR | 0.40 |
| L1 | 570 | 18 | 200 | Not | EG | 0.35 |
| L2 | 570 | 18 | 350 | Provided | CR | 0.55 |
| L2 | 570 | 20 | 250 | Not | GA | 0.55 |
| L2 | 550 | 500 | 200 | Not | EGA | 0.55 |
| M1 | 580 | 50 | 460 | Not | GA | 0.40 |
| M2 | 550 | 500 | 460 | Not | GA | 0.11 |
| N1 | 560 | 35 | 400 | Provided | CR | 0.30 |
| O1 | 570 | 20 | 430 | Not | GA | 0.65 |
| P1 | 570 | 32 | 430 | Not | GA | 0.60 |
| P2 | 560 | 25 | 450 | Not | GA | 0.60 |
| Q1 | 570 | 16 | 450 | Not | GA | 0.85 |
| R1 | 600 | 16 | 400 | Not | GI | 0.60 |
| S1 | 550 | 19 | 350 | Provided | CR | 0.60 |
| S2 | 570 | 18 | 445 | Not | GA | 0.15 |
| T1 | 570 | 8 | 450 | Not | GA | 0.45 |

The underline represents that the value is outside of the range of the present invention.

TABLE 4A

| | Surface Layer Region | | | Internal Region | | | |
|---|---|---|---|---|---|---|---|
| Product Sheet No. | Average Grain Size of Ferrite μm | Ferrite Volume Fraction % | $X_{ODF(001)/(111),S}$ in Ferrite | Average Grain Size of Ferrite μm | $X_{ODF(001)/(111),I}$ in Ferrite | $X_{ODF(001)/(111),S} - X_{ODF(001)/(111),I}$ | Evaluation of Surface Properties (Steel Sheet) |
| A1a | 10.2 | 99 | 1.30 | 12.0 | 0.93 | 0.37 | A |
| A1b | 16.7 | 98 | 0.72 | 16.8 | 0.18 | 0.54 | B |
| A2a | 13.1 | 94 | 1.70 | 13.4 | 1.31 | 0.39 | A |
| A2b | 9.8 | 100 | 0.25 | 12.6 | 0.32 | −0.07 | B |
| A2c | 11.1 | 97 | 1.25 | 13.4 | 0.88 | 0.37 | A |
| A3a | 8.1 | 99 | 0.18 | 8.0 | 0.17 | 0.01 | B |
| A4a | 10.2 | 98 | 4.20 | 10.5 | 1.60 | 2.60 | A |
| B1a | 10.2 | 97 | 0.24 | 9.5 | 0.66 | −0.42 | B |
| B2a | 5.0 | 95 | 1.30 | 9.9 | 0.44 | 0.86 | A |
| B3a | 4.6 | 95 | 1.38 | 10.8 | 0.98 | 0.40 | A |
| B4a | 3.2 | 97 | 2.96 | 10.2 | 2.15 | 0.81 | A |

TABLE 4A-continued

| | | | | | | | |
|---|---|---|---|---|---|---|---|
| B4b | 3.5 | 97 | 3.03 | 10.9 | 1.24 | 1.79 | A |
| C1a | 10.8 | 100 | 1.80 | 12.8 | 1.40 | 0.40 | A |
| C2a | 13.6 | 100 | 0.65 | 13.9 | 0.35 | 0.30 | A |
| C3a | 16.1 | 100 | 0.35 | 13.5 | 0.92 | −0.57 | B |
| C4a | 14.5 | 99 | 3.52 | 15.9 | 0.60 | 2.92 | A |
| C5a | 8.9 | 99 | 4.08 | 10.8 | 1.24 | 2.84 | A |
| C6a | 10.9 | 99 | 3.52 | 11.2 | 1.50 | 2.02 | A |
| C7a | 16.0 | 100 | 1.42 | 14.2 | 1.59 | −0.17 | A |
| D1a | 8.1 | 99 | 0.66 | 12.7 | 0.30 | 0.36 | A |
| D2a | 9.8 | 100 | 0.55 | 15.0 | 0.25 | 0.30 | A |
| D3a | 12.8 | 100 | 4.50 | 12.4 | 2.70 | 1.80 | A |
| E1a | 7.7 | 97 | 1.12 | 9.6 | 0.84 | 0.28 | A |
| E2a | 8.9 | 98 | 1.34 | 10.0 | 1.10 | 0.24 | A |
| E3a | 6.0 | 98 | 0.81 | 8.9 | 0.75 | 0.06 | B |
| E3b | 6.6 | 100 | 0.63 | 9.6 | 0.45 | 0.18 | A |
| E4a | 8.3 | 99 | 0.24 | 11.8 | 0.85 | −0.61 | B |
| F1a | 2.5 | 99 | 3.60 | 6.7 | 2.27 | 1.33 | A |
| F2a | 9.2 | 100 | 2.33 | 10.5 | 0.77 | 1.56 | A |

| | Forming Test | | | |
|---|---|---|---|---|
| Product Sheet No. | Amount ΔPa [μm] of Increase in Roughness | Evaluation of Surface Properties after Forming | Comprehensive Evaluation | Note |
| A1a | 0.11 | A | A | Example |
| A1b | 0.37 | C | C | Comparative Example |
| A2a | 0.27 | B | B | Example |
| A2b | 0.71 | D | D | Comparative Example |
| A2c | 0.25 | A | A | Example |
| A3a | 0.63 | D | D | Comparative Example |
| A4a | 0.66 | D | D | Comparative Example |
| B1a | 0.62 | D | D | Comparative Example |
| B2a | 0.24 | A | A | Example |
| B3a | 0.21 | A | A | Example |
| B4a | 0.29 | B | B | Example |
| B4b | 0.28 | B | B | Example |
| C1a | 0.25 | A | A | Example |
| C2a | 0.23 | A | A | Example |
| C3a | 0.54 | C | C | Comparative Example |
| C4a | 0.40 | C | C | Comparative Example |
| C5a | 0.64 | D | D | Comparative Example |
| C6a | 0.69 | D | D | Comparative Example |
| C7a | 0.56 | D | D | Comparative Example |
| D1a | 0.14 | A | A | Example |
| D2a | 0.16 | A | A | Example |
| D3a | 1.00 | D | D | Comparative Example |
| E1a | 0.17 | A | A | Example |
| E2a | 0.19 | A | A | Example |
| E3a | 0.13 | A | B | Example |
| E3b | 0.17 | A | A | Example |
| E4a | 0.51 | C | C | Comparative Example |
| F1a | 0.36 | C | C | Comparative Example |
| F2a | 0.10 | A | A | Example |

The underline represents that the value is outside of the range of the present invention.

TABLE 4B

| | Surface Layer Region | | | Internal Region | | | |
|---|---|---|---|---|---|---|---|
| Product Sheet No. | Average Grain Size of Ferrite μm | Ferrite Volume Fraction % | $X_{ODF(001)/(111),S}$ in Ferrite | Average Grain Size of Ferrite μm | $X_{ODF(001)/(111),I}$ in Ferrite | $X_{ODF(001)/(111),S} - X_{ODF(001)/(111),I}$ | Evaluation of Surface Properties (Steel Sheet) |
| G1a | 8.8 | 97 | 3.24 | 9.0 | 0.88 | 2.36 | B |
| G2a | 8.0 | 96 | 3.55 | 11.2 | 2.14 | 1.41 | B |
| G3a | 10.1 | 98 | 0.27 | 10.0 | 0.22 | 0.05 | B |
| H1a | 13.9 | 99 | 0.29 | 12.9 | 0.34 | −0.05 | A |
| H2a | 9.7 | 98 | 0.33 | 13.5 | 0.15 | 0.18 | A |
| H3a | 15.3 | 99 | 0.41 | 17.6 | 0.32 | 0.09 | A |
| I1a | 11.0 | 99 | 0.88 | 13.8 | 0.79 | 0.09 | B |
| I2a | 16.9 | 99 | 0.24 | 12.6 | 0.40 | −0.16 | C |
| J1a | 13.8 | 99 | 0.11 | 16.8 | 0.05 | 0.06 | A |
| J2a | 12.2 | 99 | 0.08 | 16.0 | 0.09 | −0.01 | A |
| K1a | 7.1 | 98 | 0.15 | 11.0 | 0.09 | 0.06 | A |
| K2a | 9.8 | 98 | 0.09 | 12.4 | 0.06 | 0.03 | A |

TABLE 4B-continued

| | | | | | | | |
|---|---|---|---|---|---|---|---|
| L1a | 12.1 | 100 | 0.19 | 11.9 | 0.78 | −0.59 | C |
| L2a | 5.8 | 98 | 0.27 | 9.8 | 0.08 | 0.19 | B |
| L2b | 5.2 | 99 | 0.28 | 11.4 | 0.08 | 0.20 | C |
| T2c | 3.2 | 100 | 0.26 | 7.6 | 0.09 | 0.17 | C |
| M1a | 12.6 | 100 | 0.27 | 12.0 | 0.25 | 0.02 | C |
| M2a | 9.4 | 99 | 0.26 | 9.6 | 0.62 | −0.36 | B |
| N1a | 12.7 | 100 | 0.08 | 13.4 | 0.12 | −0.04 | A |
| O1a | 7.9 | 89 | 4.55 | 10.5 | 3.10 | 1.45 | A |
| P1a | 17.4 | 97 | 0.55 | 14.3 | 1.08 | −0.53 | D |
| P2a | 11.4 | 97 | 3.57 | 12.3 | 3.47 | 0.10 | B |
| Q1a | 10.0 | 99 | 0.24 | 12.6 | 0.14 | 0.10 | B |
| R1a | 15.5 | 99 | 0.23 | 12.3 | 0.73 | −0.50 | C |
| S1a | 12.8 | 98 | 3.60 | 13.0 | 3.34 | 0.26 | A |
| S2a | 10.6 | 98 | 6.10 | 14.2 | 4.76 | 1.34 | B |
| T1a | 13.9 | 100 | 0.90 | 14.4 | 0.68 | 0.22 | B |

| | Forming Test | | | |
|---|---|---|---|---|
| Product Sheet No. | Amount ΔPa [μm] of Increase in Roughness | Evaluation of Surface Properties after Forming | Comprehensive Evaluation | Note |
| G1a | 0.07 | A | B | Example |
| G2a | 0.37 | C | C | Comparative Example |
| G3a | 0.36 | C | C | Comparative Example |
| H1a | 0.39 | C | C | Comparative Example |
| H2a | 0.30 | B | B | Example |
| H3a | 0.37 | C | C | Comparative Example |
| I1a | 0.18 | A | B | Example |
| I2a | 0.47 | C | C | Comparative Example |
| J1a | 0.92 | D | D | Comparative Example |
| J2a | 0.68 | D | D | Comparative Example |
| K1a | 0.45 | C | C | Comparative Example |
| K2a | 0.38 | C | C | Comparative Example |
| L1a | 0.67 | D | D | Comparative Example |
| L2a | 0.44 | C | C | Comparative Example |
| L2b | 0.39 | C | C | Comparative Example |
| T2c | 0.36 | C | C | Comparative Example |
| M1a | 0.56 | D | D | Comparative Example |
| M2a | 0.42 | C | C | Comparative Example |
| N1a | 0.85 | D | D | Comparative Example |
| O1a | 0.53 | C | C | Comparative Example |
| P1a | 0.39 | C | D | Comparative Example |
| P2a | 0.38 | C | C | Comparative Example |
| Q1a | 0.72 | D | D | Comparative Example |
| R1a | 1.03 | D | D | Comparative Example |
| S1a | 0.50 | C | C | Comparative Example |
| S2a | 0.65 | D | D | Comparative Example |
| T1a | 0.33 | B | B | Example |

The underline represents that the value is outside of the range of the present invention.

As shown in Tables 1 to 4B, in the examples (Examples) where the chemical composition, the metallographic structure in the surface layer region, and $X_{ODF\{001\}/\{111\},\ S}$ were in the ranges of the present invention, the result of the comprehensive evaluation was A or B, the formation of the surface unevenness was suppressed in the stage of the steel sheet and after working. On the other hand, in the examples (Comparative Examples) where one or more of the chemical composition, the metallographic structure in the surface layer region, and $X_{ODF\{001\}/\{111\},\ S}$ were outside of the ranges of the present invention, a pattern was formed or unevenness occurred in the stage of the steel sheet or after forming such that the material was not able to be used as an exterior material or a component.

FIG. 1 is a diagram showing a relationship between surface properties after forming and a texture parameter obtained in Examples. The ■ plot of FIG. 1 shows an example where the average grain size of ferrite in the surface layer region was more than 15.0 μm.

Referring to FIG. 1, it can be seen that the surface properties after forming were excellent in the examples where the texture parameter was in the range of the present invention (the ratio $X_{ODF\{001\}/\{111\},\ S}$ of the intensity of [001] orientation to the intensity of {111} orientation in ferrite was 0.30 or more and less than 3.50).

INDUSTRIAL APPLICABILITY

With the above-described aspect of the present invention, a high strength steel sheet in which formability is excellent and the occurrence of surface unevenness is suppressed even after various deformation during press forming can be manufactured. Therefore, the industrial applicability is high.

The invention claimed is:

1. A steel sheet comprising, as a chemical composition, by mass %:

C: 0.0015% to 0.0320%;
Mn: 0.20% to 1.50%;
P: 0.010% to 0.100%;
Cr: 0.001% to 0.500%;
Si: 0.200% or less;
S: 0.020% or less;
sol. Al: 0.200% or less;
N: 0.0150% or less;

Mo: 0% to 0.500%;
B: 0% to 0.0100%;
Nb: 0% to 0.200%;
Ti: 0% to 0.200%;
Ni: 0% to 0.200%;
Cu: 0% to 0.100%; and
a remainder including iron and impurities,
wherein a metallographic structure in a surface layer region includes ferrite having a volume fraction of 90% or more, and
in the surface layer region,
an average grain size of the ferrite is 1.0 μm to 15.0 μm, and
a texture in which an $X_{ODF\{001\}/\{111\},\ S}$ as a ratio of an intensity of {001} orientation to an intensity of {111} orientation in the ferrite is 0.30 or more and less than 3.50 is included.

2. The steel sheet according to claim 1,
wherein the chemical composition includes, by mass %, one or more of:
Mo: 0.001% to 0.500%;
B: 0.0001% to 0.0100%;
Nb: 0.001% to 0.200%;
Ti: 0.001% to 0.200%;
Ni: 0.001% to 0.200%; and
Cu: 0.001% to 0.100%.

3. The steel sheet according to claim 2,
wherein a plating layer is provided on a surface.

4. The steel sheet according to claim 1,
wherein a texture in which an $X_{ODF\{001\}/\{111\},\ I}$ as a ratio of an intensity of {001} orientation to an intensity of {111} orientation in ferrite is 0.001 or more and less than 1.00 is included in an internal region.

5. The steel sheet according to claim 4,
wherein the intensity ratio $X_{ODF\{001\}/\{111\},\ S}$ and an $X_{ODF\{001\}/\{111\},\ I}$ as a ratio of an intensity of {001} orientation to an intensity of {111} orientation in ferrite in an internal region satisfy the following Expression (1), and
the average grain size of the ferrite in the surface layer region is less than an average grain size of the ferrite in the internal region, $$-0.20<X_{ODF\{001\}/\{111\},\ S}-X_{ODF\{001\}/\{111\},\ I}<0.40 \quad (1).$$

6. The steel sheet according to claim 5,
wherein a plating layer is provided on a surface.

7. The steel sheet according to claim 4,
wherein a plating layer is provided on a surface.

8. The steel sheet according to claim 1,
wherein a plating layer is provided on a surface.

9. The steel sheet according to claim 1, wherein ΔPa is 0.35 μm or less.

10. A method for manufacturing a steel sheet according to claim 1, the method comprising:
a heating process of heating a slab having the chemical composition according to claim 1 to 1000° C. or higher;
a hot-rolling process of hot-rolling the slab such that a rolling finishing temperature is 950° C. or lower to obtain a hot-rolled steel sheet;
a stress application process of applying a stress to the hot-rolled steel sheet after the hot-rolling process such that an absolute value of a residual stress $\sigma_S$ on a surface is 100 MPa to 250 MPa;
a cold-rolling process of cold-rolling the hot-rolled steel sheet after the stress application process such that a cumulative rolling reduction $R_{CR}$ is 70% to 90% to obtain a cold-rolled steel sheet;
an annealing process of heating the cold-rolled steel sheet such that an average heating rate in a range from 300° C. to a soaking temperature T1° C. that satisfies the following Expression (2) is 1.5° C./sec to 10.0° C./sec and holding the heated steel sheet at the soaking temperature T1° C. for 30 seconds to 150 seconds for annealing; and
a cooling process of cooling the cold-rolled steel sheet after the annealing process to a temperature range of 550° C. to 650° C. such that an average cooling rate in a range from the soaking temperature T1° C. to 650° C. is 1.0° C./sec to 10.0° C./sec and cooling the cooled steel sheet to a temperature range of 200° C. to 490° C. such that the average cooling rate is 5° C./sec to 500° C./sec, $$Ac+550-25\times\ln(\sigma_S)-4.5\times R_{CR}\leq T1\leq Ac_1+550-25\times\ln(\sigma_S)-4\times R_{CR} \quad (2)$$

$Ac_1$ in Expression (2) is represented by the following Expression (3),
an element symbol in the following Expression (3) represents an amount of the corresponding element by mass %, and when the corresponding element is not included, 0 is substituted into the corresponding element symbol, and $$Ac_1=723-10.7\times Mn-16.9\times Ni+29.1\times Si+16.9\times Cr \quad (3).$$

11. The method for manufacturing a steel sheet according to claim 10,
wherein the stress application process is performed at 40° C. to 500° C.

12. The method for manufacturing a steel sheet according to claim 10,
wherein in the hot-rolling process, a finish rolling start temperature is 900° C. or lower.

13. The method for manufacturing a steel sheet according to claim 10, the method further comprising:
a holding process of holding the cold-rolled steel sheet after the cooling process in a temperature range of 200° C. to 490° C. for 30 seconds to 600 seconds.

* * * * *